US006015346A

United States Patent [19]

Bennett

[11] Patent Number: 6,015,346

[45] Date of Patent: Jan. 18, 2000

[54] INDICIA SELECTION GAME

[75] Inventor: Nicholas Luke Bennett, Manly Vale, Australia

[73] Assignee: Aristocat Leisure Industires Pty. Ltd., Lame Cove, Australia

[21] Appl. No.: 09/117,559

[22] PCT Filed: Jan. 24, 1997

[86] PCT No.: PCT/AU97/00044

§ 371 Date: Jul. 27, 1998

§ 102(e) Date: Jul. 27, 1998

[87] PCT Pub. No.: WO97/27569

PCT Pub. Date: Jul. 31, 1997

[30] Foreign Application Priority Data

Jan. 25, 1996 [AU] Australia ..... PN 7754

[51] Int. Cl.[7] ..... A63F 3/06; A63F 9/22

[52] U.S. Cl. ..... 463/20; 463/16; 463/17; 273/138.2; 273/139; 273/143 R; 273/273

[58] Field of Search ..... 463/13, 16–18, 463/30, 20; 273/273, 138 A, 139, 138 R, 193 R, 138.2

[56] References Cited

U.S. PATENT DOCUMENTS 1,527,929 2/1925 Simons ..... 273/274
5,092,598 3/1992 Kamille ..... 273/139
5,605,504 2/1997 Huang ..... 462/22

FOREIGN PATENT DOCUMENTS 2328195 1/1996 Australia .
2107092 10/1996 Australia .
4402800 3/1995 Germany .
1348309 3/1974 United Kingdom .
2119989 11/1983 United Kingdom .

OTHER PUBLICATIONS

"Concentration", Scarne's Enyclopedia Of Games, John Scarne, Harper & Row Publishers, p. 364, 1973.

*Primary Examiner*—Benjamin H. Layno
*Attorney, Agent, or Firm*—Friedman Siegelbaum LLP

[57] ABSTRACT

A slot machine providing a video display screen controlled to display indicia images arranged in a matrix. The video screen is of the touch sensitive variety, having an array of touch sensitive areas located on its display surface with one such area associated with each matrix element. The player selects pairs of indicia by touching the screen within the area of each of the displayed indicia to be selected, thereby causing the indicia to change to reveal the associated prize values.

14 Claims, 5 Drawing Sheets

INDICIA SELECTION GAME

TECHNICAL FIELD

The present invention relates to gaming machines of the type generally referred to as slot machines, fruit machines or poker machines, and in particular the invention provides an improvement to a game played on such a machine.

Players who regularly play gaming machines quickly tire of particular games and therefore it is necessary for manufacturers of these machines to come up with innovative game features that add interest to the games provided on such machines in order to keep the players amused and therefore willing to continue playing the game.

DESCRIPTION OF THE PRIOR ART

Gaming or poker machines have been well known in the state of New South Wales for many years and have more recently gained considerable popularity throughout Australia, with quite substantial amounts of money wagered on these machines. There is a growing tendency for State governments to legalize the use of gaming machines by licensing operators, with resulting revenue gains through license fees and taxation of monies invested. The licensed operation of gaming machines is the subject of State legislation and regulation. This regulation almost always dictates a minimum percentage payout for a gaming machine. For example, a minimum of 85% of monies invested must be returned as winnings, and manufacturers of gaming machines therefore must design their machines around these regulatory controls.

With the growth that has occurred in the gaming machine market there is intense competition between manufacturers to supply the various existing and new venues. When selecting a supplier of gaming machines, the operator of a venue will often pay close attention to the popularity of various games with their patrons.

Therefore, gaming machine manufacturers are keen to devise games which are popular with players, as a mechanism for improving sales.

In particular, manufacturers regularly devise new games which have not previously been seen on slot machines in order to stimulate renewal of player interest.

SUMMARY OF THE INVENTION

According to a first aspect, the present invention provides a slot machine including display means arranged to display a game being played on the machine, game initiating means to initiate a game on the machine and game control means responsive to the initiating means to control the playing of the game, characterized in that the display means is arranged to display a plurality of indicia each indicia being associated with a prize or prize symbol which is initially not displayed, the machine including indicia selection means arranged to allow a player to select at least one pair of indicia, and the control means being arranged to reveal the prize or prize symbol associated with each of the selected pair of indicia and to award a prize to the player, in the event that a pair of selected indicia are each associated with the same prize or prize symbol or are associated with a predetermined pair of prizes or prize symbols, awarding a prize to the player.

In the preferred embodiment the display means is a touch sensitive video screen and the player selects indicia pairs by touching areas of the screen on which the selected indicia are displayed. However, other selection mechanisms are also possible such as buttons indicating grid references on the display, and the display can be a mechanical or electromechanical device such as a set of rotatable reels, with shutters or blinds over the display window.

Preferably, the display will provide a matrix of indicia locations which may be represented by video simulations of overturned cards, rotatable blocks or any other suitable representation. Preferably, the player will select the required pair of indicia by touching the respective screen locations which will result in the indicia changing, by for example flipping the cards face up or rotating the blocks to reveal a second face.

In some embodiments the selected indicia will change appearance as described above to reveal prizes or prize values, however it is also possible to simply display symbols such as playing card faces which correspond to a predetermined prize. In each case, matching two similar prizes or symbols or a predetermined pair of dissimilar prizes or symbols will result in a prize being awarded to the player. In one example, selecting a pair of indicia will directly reveal cash values associated with each indicia and if a pair of indicia are selected which each reveal the same cash value, that value is awarded to the player. In an extension of this embodiment one or more indicia may be associated with a wild symbol instead of a cash value and selection of a wild symbol as one of the pair will result in the prize associated with the second selected indicia being awarded.

Embodiments of the invention may either use a single deck of cards from which all hands are dealt or alternatively each hand may be dealt from its own separate deck. In the event that separate decks are used for each hand, embodiments will often also include a draw feature in which the player may select the cards which he wishes to keep in each hand, the rest being discarded and replaced by the machine redealing an equivalent number of cards. The draw feature may also be incorporated in machines that deal each hand from a single deck, however, it can be difficult to combine the draw feature with some of the other features which may be included in such games.

In embodiments which draw all hands from one deck, it is possible to set up more pay lines than there are hands. For example, if three hands are dealt, it is possible to have more than three pay lines, however, as some of the pay lines will use cards in common with others of the pay lines, the draw feature is inappropriate in such machines.

BRIEF DESCRIPTION OF THE DRAWINGS

Embodiments of the present invention will now be described by way of example with reference to the accompanying drawings in which.

DETAILED DESCRIPTION OF THE PREFERRED EMBODIMENTS

In the following detailed description, the methodology of the embodiments will be described and it is to be understood that it is within the capabilities of the non-inventive worker in the art to introduce the methodology on any standard microprocessor based gaming machine by means of appropriate programming.

Figure 1:
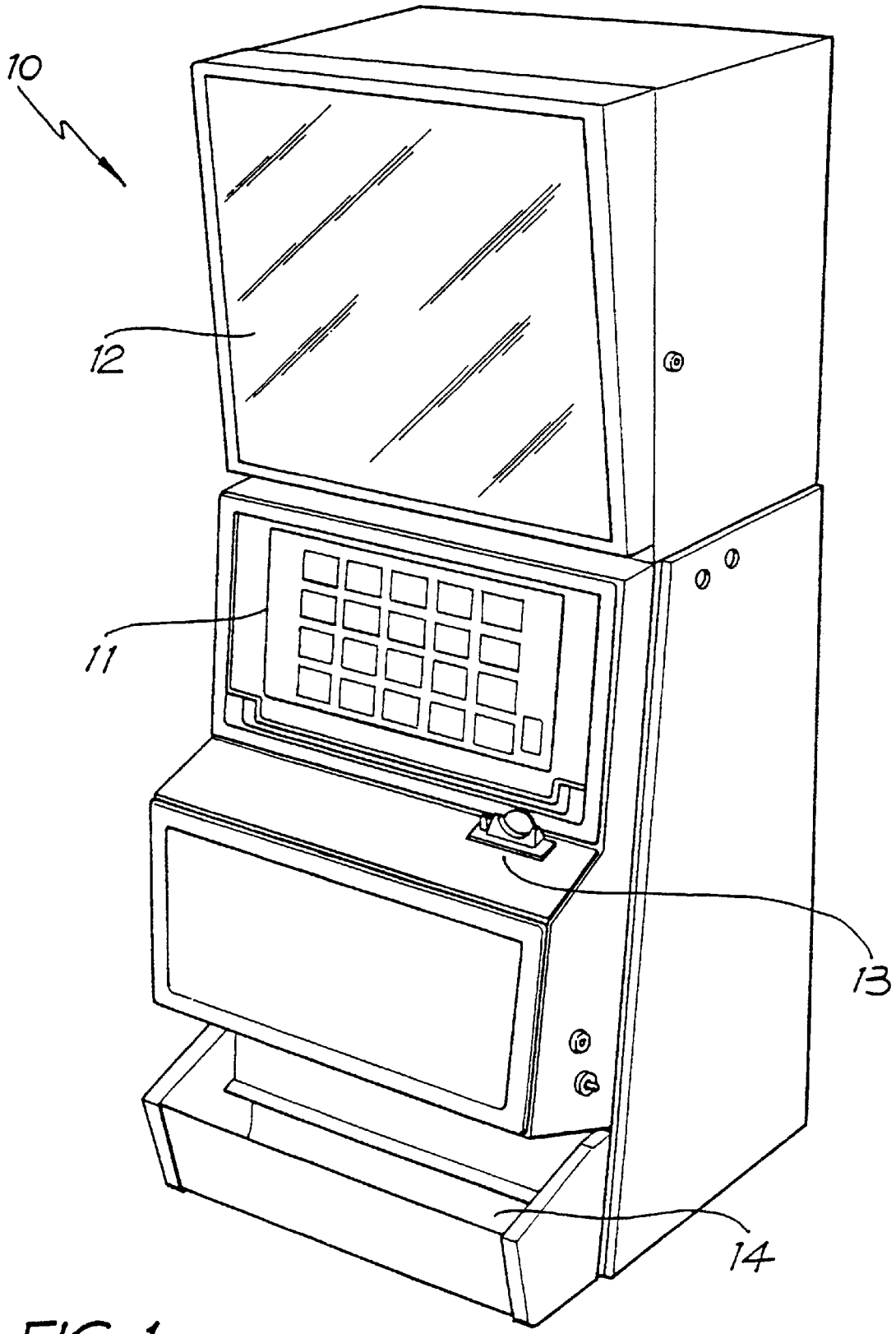
FIG. 1 illustrates a touch screen slot machine incorporating the present invention.
Figure 4:
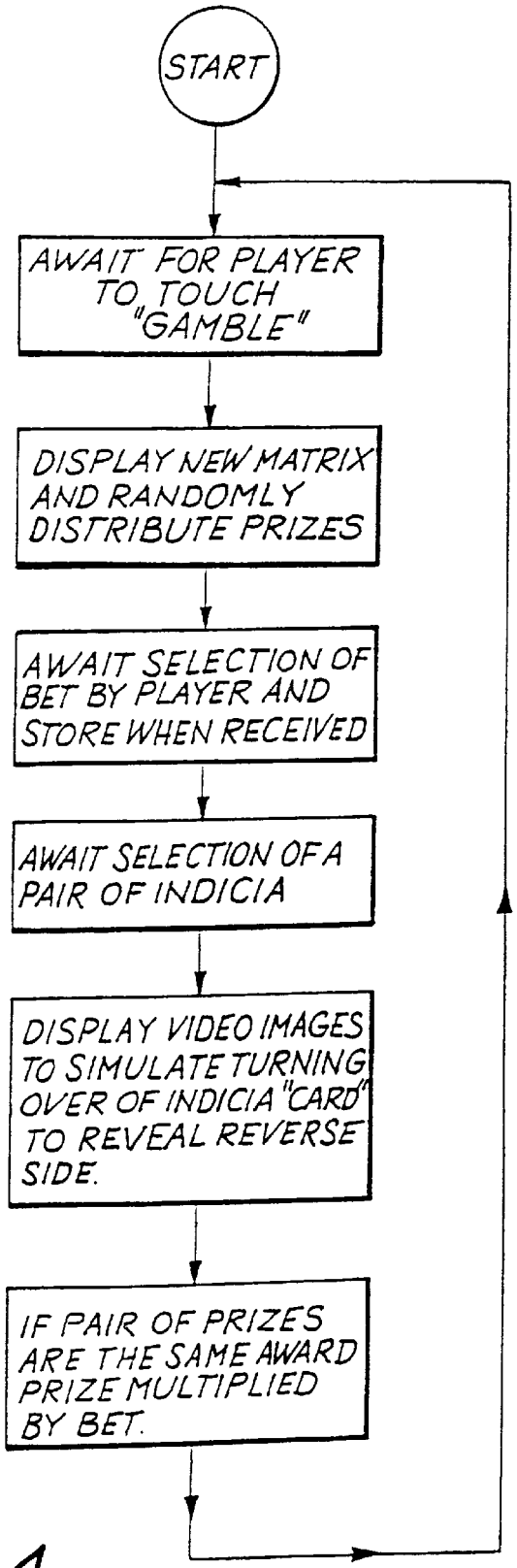
FIG. 4 is a flow chart showing operation of the game described with reference to FIG. 2.

Referring to FIG. 1, the illustrated embodiment of the invention is housed in a conventional slot machine cabinet 10 including a prize display 12, a coin entry slot 13, a payout tray 14 and internally mounted game control processor circuits (refer to FIG. 4).

Preferably, the game display means 11 comprises a video display screen 11 controlled to display indicia images arranged in a matrix. The video screen is preferably of the touch sensitive variety, having an array of touch sensitive areas located on its display surface with one such area associated with each matrix element 40–54 (refer to FIG. 2). The player selects pairs of indicia (e.g. 41 and 48) by touching the screen within the area of each of the displayed indicia (i.e. within the area of the matrix element) to be selected, thereby causing the indicia to change to reveal the associated prize values (refer to 41 and 48 in FIG. 3). Additional player controls are implemented by displaying images 18, 19, 20, 21, 22, 23, corresponding to controls on the screen such that when the control images are touched, the associated function is caused to be performed.

Figure 2:
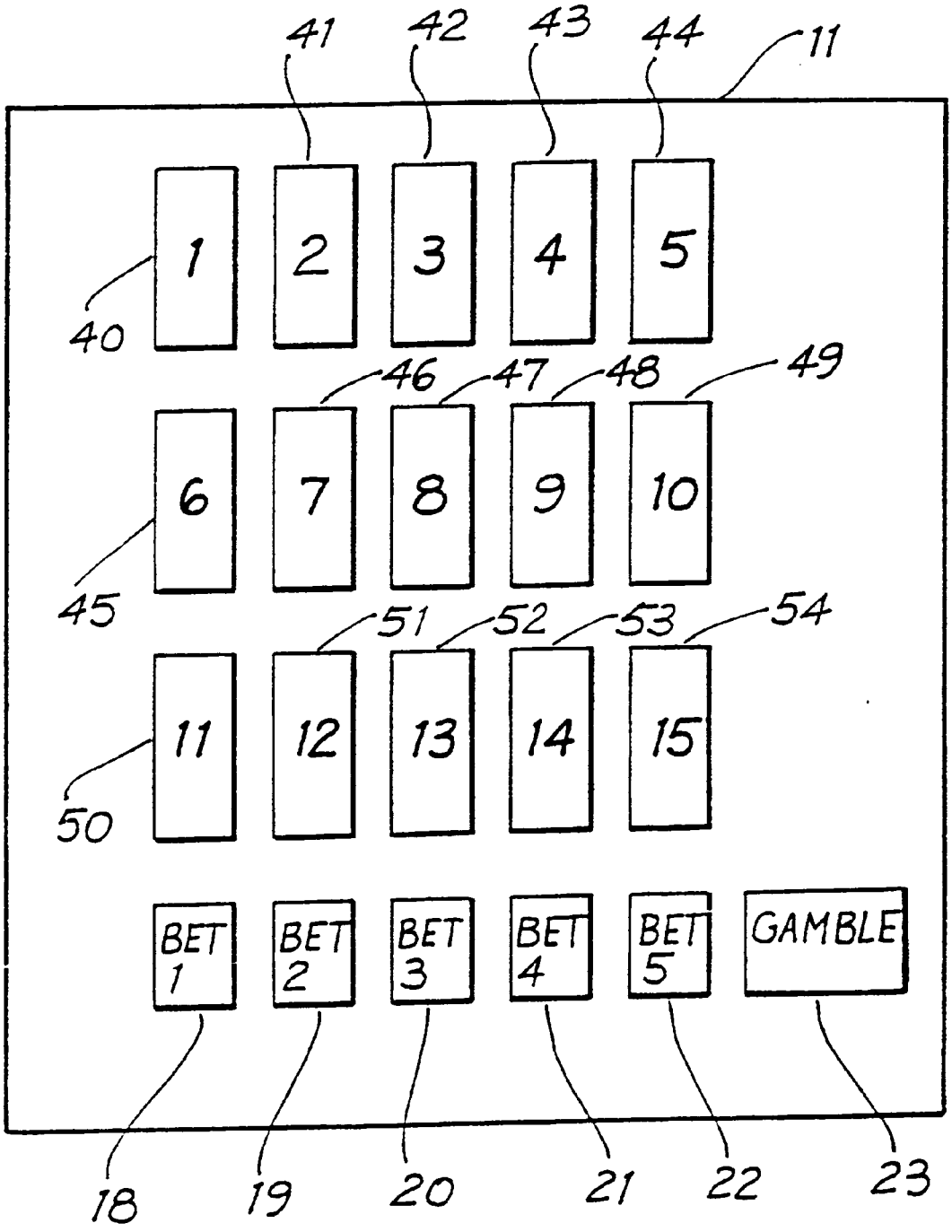
FIG. 2 illustrates a screen layout for an embodiment of the invention.
Figure 3:
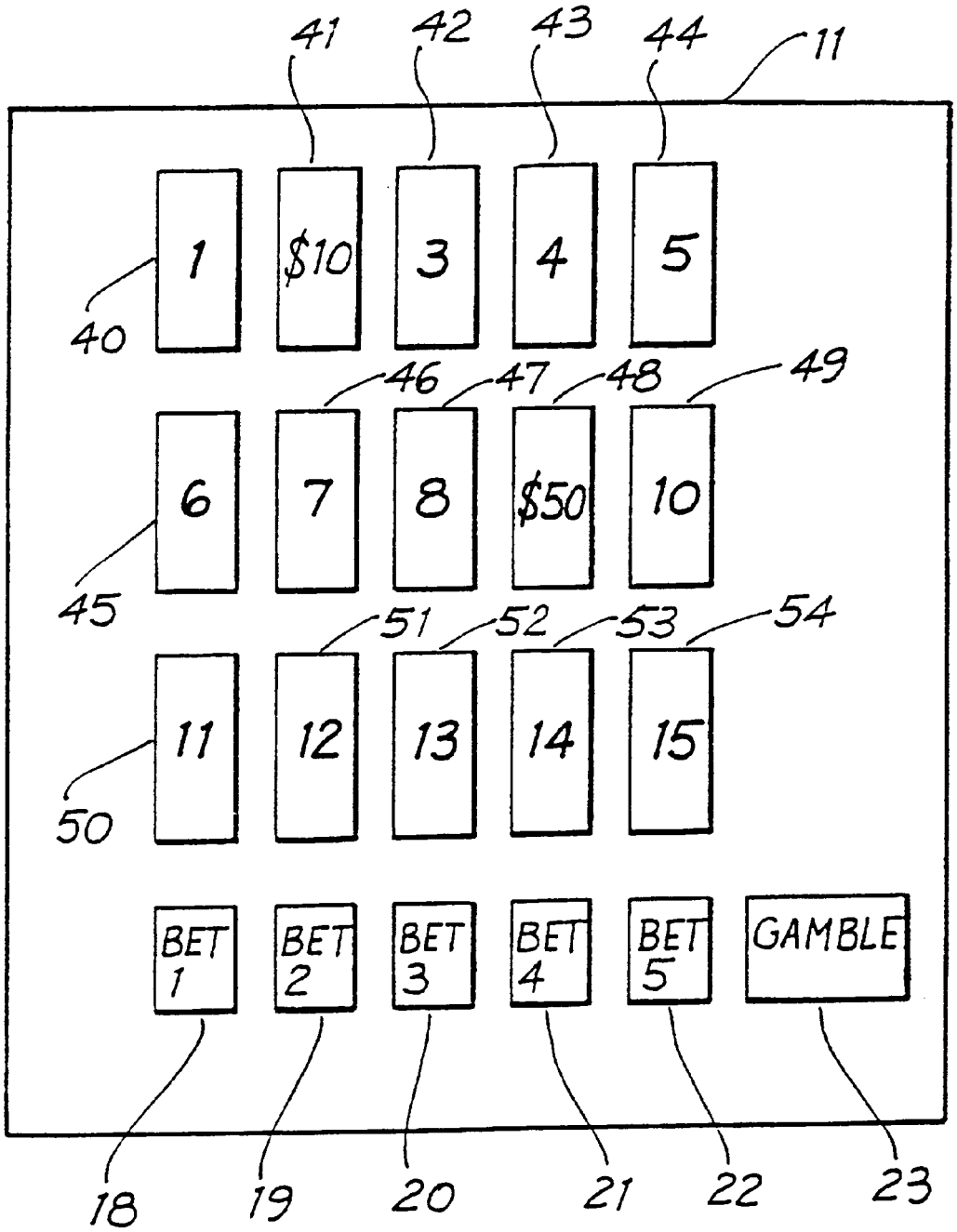
FIG. 3 illustrates the screen layout of FIG. 2 after two indicia have been selected.

Referring to FIG. 2, a screen layout is illustrated for a first embodiment of the invention. In this embodiment, one such player control is a gamble button 23, which when touched causes a game to be initiated. Additionally, buttons 18, 19, 20, 21 and 22 enable bets of 1–5 credits to be placed on each game. The player first touches the gamble button 23 which causes the game to commence and a matrix of indicia 40–54 to be displayed.

Once the matrix of indicia is displayed, the player may select his bet which will be deducted from his available credit (and will cause the prize to be multiplied by the number of bet units selected). In some embodiments bet selection may not be provided and all bets will be of one unit After the player has selected his bet using buttons 18–22 he may select a pair of indicia by touching the appropriate screen positions (e.g. 41 and 48).

As the player selects each of a pair of indicia they will be shown to turn over to reveal a prize value and in the event that the two prize values are identical or one of the indicia reveals a wild symbol, a prize is awarded to the player. The prize will be the value revealed multiplied by the number of units bet, if appropriate.

When the game commences, the indicia displayed may all be identical, as for example the backs of cards, or the indicia may make up a picture or provide some other graphic image. In the embodiment of FIG. 2 the indicia are 15 numbered boxes. Also the indicia need not form a matrix, but could for example be distributed in some other pattern such as a tree shape or a random distribution.

Referring to FIG. 4, a flow diagram is illustrated to show the logic of a control program which controls the operation of the game. From this diagram it will noted that after starting the game, the machine awaits the touching of the gamble button 23 to commence the game. The control program then causes the display of a new matrix of indicia and randomly associates prizes with each displayed indicia.

Figure 5:
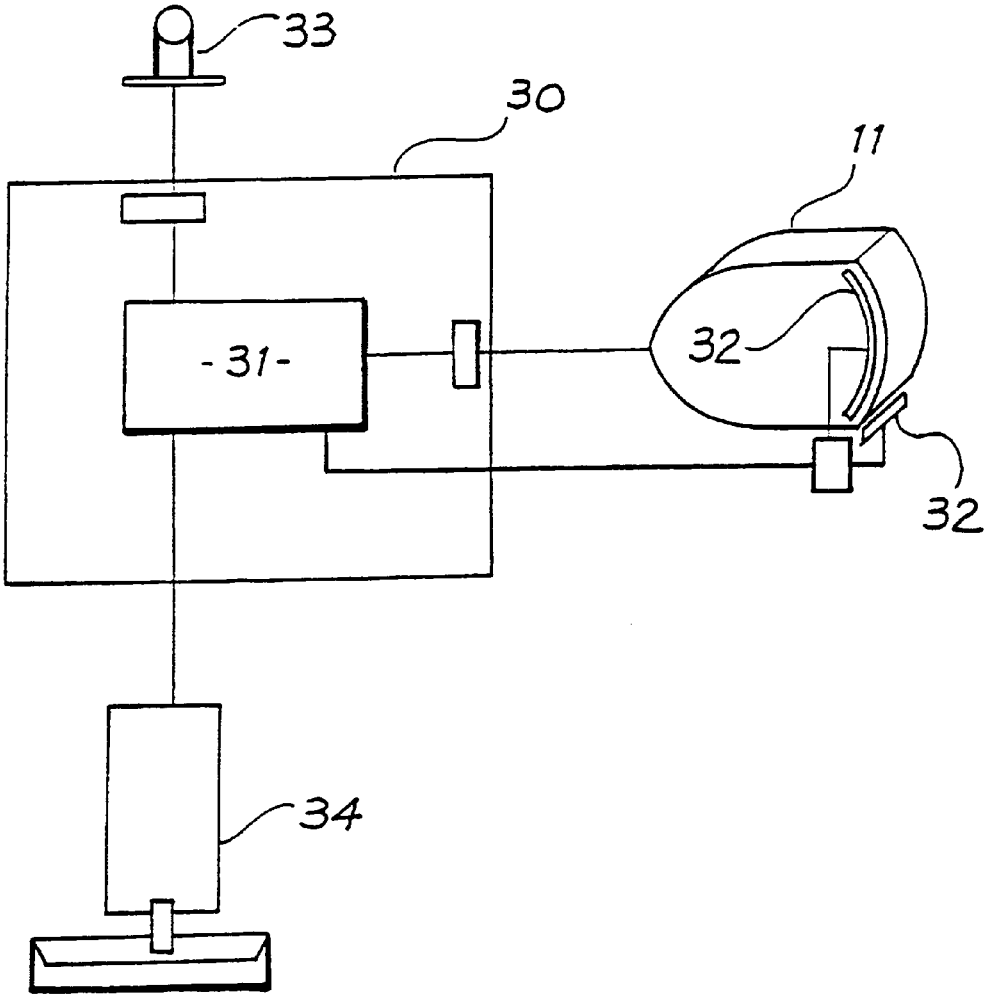
FIG. 5 is a schematic diagram of a slot machine control circuit.

The program to implement the sequence of FIG. 4 runs on a standard gaming machine control processor 31 as illustrated schematically in FIG. 5. This processor forms part of a controller 30 which drives the display screen 11 and receives touch input signals from touch sensors 32 as well as receiving coin input pulses from a coin chute mechanism 33 and driving a coin payout mechanism 34.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. A slot machine including display means arranged to display a game being played on the machine, game initiating means to initiate a game on the machine and game control means responsive to the initiating means to control the playing of the game, characterized in that the display means is arranged to display a plurality of indicia, each indicia being associated with a prize or prize symbol which is initially not displayed, the machine including indicia selection means arranged to allow a player to select at least one pair of indicia, and the control means being arranged to reveal the prize or prize symbol associated with each of the selected pair of indicia and to award a prize to the player in the event that a pair of selected indicia are each associated with the same prize or prize symbol or are associated with a predetermined pair of prizes or prize symbols.

2. The slot machine as claimed in claim 1 wherein the display provides a matrix of indicia locations which are represented by images of overturned cards.

3. The slot machine as claimed in claim 1 wherein the display provides a matrix of indicia locations which are represented by images of rotatable blocks.

4. The slot machine of claim 1, wherein the display means is a touch sensitive video screen and the player selects indicia pairs by touching areas of the screen on which the selected indicia are displayed.

5. The slot machine of claim 4 wherein the player selects the required pair of indicia by touching the respective screen locations which will result in the indicia changing to reveal a second face.

6. The slot machine of claim 1, including buttons indicating grid references on the display such that indicia positions may be selected by the player pressing the buttons.

7. The slot machine of claim 6 wherein the display is a mechanical or electromechanical device.

8. The slot machines of claim 7 wherein the display means is a set of rotatable reels, with shutters or blinds over the display window.

9. The slot machine of claim 1, in which the selected indicia will change appearance to reveal prizes or prize values.

10. The slot machine of claim 1, wherein the selected indicia change appearance to display symbols which correspond to a predetermined prize.

11. The slot machine of claim 10 wherein the symbols are playing card faces.

12. The slot machine of claim 1, wherein matching two similar prize symbols or a predetermined pair of dissimilar prize symbols will result in a prize being awarded to the player.

13. The slot machine of claim 12 wherein one or more indicia are associated with a wild symbol instead of a particular prize and selection of a wild symbol as one of the pair will result in the prize associated with the second selected indicia, or a multiple of that prize, being awarded.

14. The slot machine of claim 1, wherein selecting a pair of indicia will directly reveal cash values associated with each indicia and if a pair of indicia are selected which each reveal the same cash value, the value is awarded to the player.

* * * * *

UNITED STATES PATENT AND TRADEMARK OFFICE
Certificate

Patent No. 6,015,346

Patented: January 18, 2000

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Colin Fong, Lane Cove, Austrailia.

Signed and Sealed this Eleventh Day of March 2003.

PAUL T. SEWELL
*Supervisory Patent Examiner*
Art Unit 3711